United States Patent [19]

Föhl

[11] 4,408,374

[45] Oct. 11, 1983

[54] BELT LOCK FOR A SAFETY BELT

[75] Inventor: Artur Föhl, Schorndorf, Fed. Rep. of Germany

[73] Assignee: Repa Feinstanzwerk GmbH, Alfdorf, Fed. Rep. of Germany

[21] Appl. No.: 250,040

[22] Filed: Apr. 1, 1981

[30] Foreign Application Priority Data

Apr. 2, 1980 [DE] Fed. Rep. of Germany ..... 3012937

[51] Int. Cl.[3] ..... A44B 11/26

[52] U.S. Cl. ..... 24/230 A

[58] Field of Search ..... 24/230 A, 230 R, 230 AL

[56] References Cited

U.S. PATENT DOCUMENTS 3,597,811 8/1971 Cunningham ..... 24/230 A 3,871,090 3/1975 Romanzi, Jr. et al. ..... 24/230 A 3,935,618 2/1976 Fohl ..... 24/230 A

*Primary Examiner*—Hugh R. Chamblee

*Attorney, Agent, or Firm*—Herbert L. Lerner; Laurence A. Greenberg

[57] ABSTRACT

Belt lock for a safety belt with passageway in a lock-housing for belt tongue. Latch mechanism in lock-housing to arrest tongue. Lock mechanism can be unlocked by pressing pressure organ. Latching mechanism has a latch of wedge-shaped cross section swingably supported in corresponding wedge-shaped openings with a greater wedge angle. The latch bears with its smaller rounded end in a curved bearing surface of the opening, and at its wide wedge-end has a convexly curved support edge for the tongue.

1 Claim, 3 Drawing Figures

BELT LOCK FOR A SAFETY BELT

CROSS-REFERENCE TO RELATED APPLICATION

My application Ser. No. 250,039, filed on Apr. 1, 1981.

BACKGROUND OF THE INVENTION

1. Field of the Invention

The invention relates to a belt lock for a safety belt with a plug-in guide provided in a lock-housing for a belt plug-in tongue which can, by a latch mechanism be arrested in the plug-in guide, and which can be unlocked by operation of a pressure organ against the force of a spring.

2. Description of the Prior Art

In the known safety belt systems comprising a plug-in tongue and a belt lock, at least one latch is provided in the interior of a stable metallic lock-housing. The latch can swing on a swing-axis, and is pressed by a spring into the plug-in guide for the tongue. The mentioned belt lock is fastened at the floor or chassis of the motor vehicle, while the plug-in tongue is fastened at the free end of the safety belt which, for example, can be rolled in or out from an automatic roll-up device. Conventionally, the latches are hereby essentially of rectangular shape. To obtain a secure locking position, this rectangular latch must, in the locking position, be at a certain angle with the lock-or plug-in axis. At the insertion of the tongue into the lock-housing, the leading pressure edge of the plug-in tongue must press the obliquely positioned latch outward, until it is outside of the plug-in guide, whereby, in the case of a latch with a rectangular cross-section, the tongue acts at a very short lever arm with respect to the pivot point of the lever. This makes the insertion more difficult, and increases the wear correspondingly with continuous usage.

SUMMARY OF THE INVENTION

An objective of the invention is to provide a belt lock of the initially described type with a simple construction in a manner that the operation of the safety belt system is made easier.

With the foregoing and other objects in view, there is provided in accordance with the invention a lock for a safety belt comprising a belt lock having a lock-housing with two spaced plates defining an insertion path, a plug-in tongue with a detent for insertion in the insertion path of the lock-housing, a latch mechanism having a latch of wedge-shaped cross section which can swing into the detent of the plug-in tongue when inserted in the insertion path to thereby engage the tongue, the wedge-shaped latch being swingeably supported in a corresponding wedge-shaped opening with a greater wedge angle, the latch bearing with its smaller wedge end in a curved bearing surface of the opening, the latch having at its wide wedge end a convexly curved surface for contact with the tongue, and a pressure organ mounted on the lock-housing movable against the force of a spring to move the latch out of engagement with the tongue to permit withdrawal of the tongue from the belt lock.

Other features which are considered as characteristic for the invention are set forth in the appended claims.

Although the invention is illustrated and described herein as embodied in a belt lock for a safety belt, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 2:
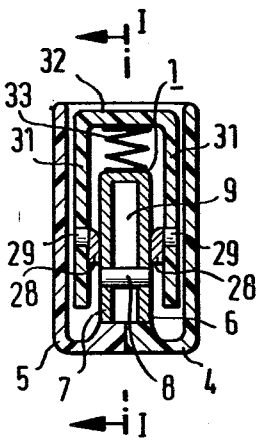
FIG. 2 is a sectional view of the belt lock taken along the line II—II of FIG. 1.

According to the invention the latching mechanism is provided with at least one latch which can swing into the plug-in guide. The latch has a wedge-shaped cross section, and is swingeably supported in corresponding wedge-shaped openings with a greater wedge angle. The latch bears with its smaller rounded end in a curved bearing surface of the opening, and at its wide wedge end is provided with a convexly curved support edge for the plug-in tongue. Because of the wedge-shaped form of the latch, the tongue acts on a relative long lever arm of the latch when the tongue is inserted into the push-in guide, and presses the latch until it lies outside of the push-in guide, so that after sliding-up the relative long wedge-surface of the latch, the latter can easily snap into the engagement detent. A special advantage thereby is that the tongue does remain in position during the opening operation, i.e. it does not move in the push-in direction, because there is no undercut of any kind between latch and the engagement edge of the tongue, which could cause such a motion, and thereby require additional effort.

According to a further embodiment of the invention, the material of the latch has a greater hardness than the material of the plug-in tongue, or at least of the engagement edge of the latter. In this way, a corresponding deformation of the engagement edge occurs when a load is applied to the plug-in tongue, and thereby an exact fitting of the engagement edge on the latch profile is effected, so that an uniform distribution of the pull-forces over a larger area is assured. Consequently, it is not necessary to shape the engagement edge of the tongue concavely; it can be straight.

The invention can be advantageously applied to systems with an asymmetrical, one-sided detent hole in the plug-in tongue, and a correspondingly one-sided arrangement of the latch in the lock housing, as well as also at a symmetrical, two-sided arrangement of engagement edges and latches relative to the plug-in axis. Furthermore, any manually operated pressure system can be used for operation of the single latch or the latches which are supported in the wedge-shaped openings of the lock-housing, for example, a pressure key or a sliding element, which is suited to induce a swing motion to the latch or latches. Further advantageous details of the invention can be learned from the typical embodiment shown in the drawings, and described in the following.

Referring to the drawings, a U-shaped metallic housing 1 is made as a formed stamped part, to which a fastening lug 3 is attached by two rivets 2. Lug 3 can be attached, for example, to a holding rope which is secured to the floor of the vehicle. The housing 1 of the lock is surrounded by two housing shells 4 and 5 made of plastic, which together enclose the housing 1. A guide pin 8 is supported in the plates 4 and 5, which together with the inner surfaces of the plates 6 and 7 form an insertion path 9 for a metallic plug-in tongue 10. The end of a flexible safety belt 12 is fastened in the ear-like expanded portion 11 of tongue 10, and the other belt end is fixed to the frame of the vehicle, at a so-called automatic roll-up device. The plug-in tongue 10 in the shown embodiment is provided at one longitudinal edge 13 with a detent 14 which is open to the outside, and has a slanted engagement edge 15 which continues into a run-up slant 16. This plug-in tongue 10 can be inserted by hand into the plug-in path 9 of the housing 1, up to the position shown in dashed lines in FIG. 1. The guide pin 8 serves for supporting and guiding of the inserted tongue, and prevents a deviation of the latter. During the insertion, the plug-in tongue 10 presses against an ejection spring 17 disposed in a notch 18 of the fastening lug 3, to make certain that after loosening the connection between the housing 1 and the plug-in tongue 10, the latter is ejected from the housing 1. The plug-in tongue 10 can also be provided with a second engagement detent 14' at the opposite longitudinal edge which is shown with dash-lines.

A retainer plate 19 is provided with two cut-outs 20, and can be pushed onto two lugs 21 of the housing 1, and which at one hand maintains the distance between the plates 6 and 7, and also limits the entrance of the plug-in path 9 directing the tongue 10 toward the back.

Figure 1:
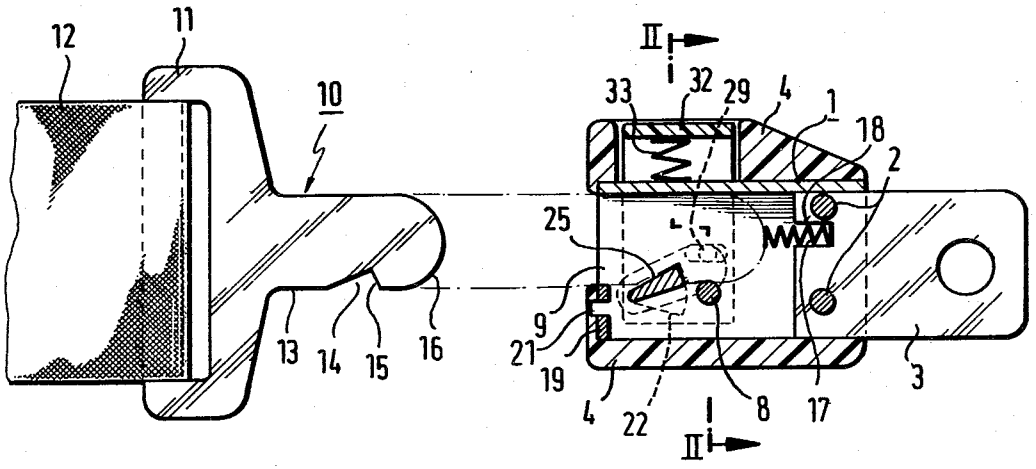
FIG. 1 is a sectional view of the belt lock according to the invention taken along line I—I of FIG. 2, together with the plug-in tongue. The drawings show the lock-housing forming an insertion path for the plug-in tongue, and a wedge-shaped latch swingeable in the insertion path, as well as a pressure element to move the latch out of the insertion path.
Figure 3:
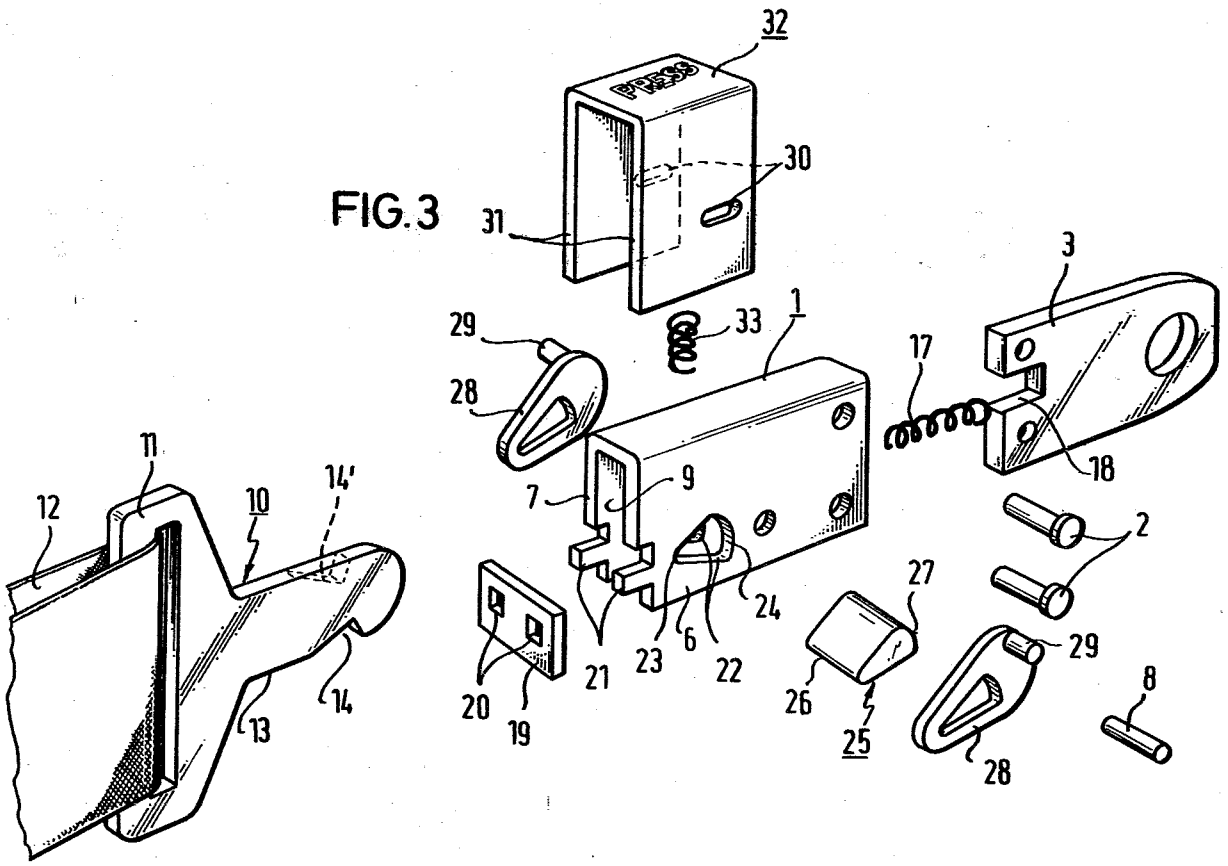
FIG. 3 shows an exploded view of the belt-lock with the plug-in tongue according to FIGS. 1 and 2.

In the plates 6 and 7 of the housing 1 there are wedge or sector-shaped support openings 22, which at the narrow wedge endings are provided with round corners 23, and with concavely arched edges 24 at the other side. In these support openings 22, a latch 25, which also has a wedge shape and a smaller wedge angle than the support openings 22 is hingeably supported. The latch 25 is rounded at its small end 26, and is hingeably or pivotably supported in the round corners 23 of the support openings 22, while its other wider end is provided with a convexly curved support edge 27, corresponding to the contour of the support openings 22. The latch 25 consists of a material having greater hardness and stiffness than the engagement edge 15 of the tongue 10, so that the engagement edge 15 adjusts itself to the form of the latch 25 at an extreme load on the safety belt 12 in the case of a crash. At both sides of the plates 6 and 7 are plate-like lever elements 28 fastened to the ends of the latch 25, for example by press-fits, or formed on the latch. Levers 28 are provided with freely extending lever pins 29, which lie outside of the swing-axis of the latch 25. Onto these lever pins 29 can be snapped on the free, form-stable legs 31 with guide slots 30 of a U-shaped pressure element 32 "Press". This hand-operated pressure organ 32 straddles the housing 1, is guided at the side of the housing, and tensioned by a spring 33 in the non-operating position. A part of the cam-edge (wear edge) 27 of the latch 25 projects over the described lever mechanism into the push-in path 9, and—after insertion of the tongue 10—engages with the detent edge 15, as shown in FIG. 1. By pressing the pressure organ 32 against the spring force 33, the latch 25 is moved outside of the push-in path 9, so that the plug-in tongue 10 is released. By means of the special form and arrangement of the latch 25 the plug-in tongue 10 does not move when the latch 25 is displaced; the tongue 10 stays in its position until the locking-connection is completely freed.

As the drawings show, the plug-in tongue 10 is provided at its forward end in the plug-in direction with a wart-like stamped shape 34, which extends beyond one flat side 35 of the plug-in tongue 10. Correspondingly, a groove-like recess 36 is stamped into a plate 7 of the housing 1, along the plug-in path 9. By the asymetrical guide profile of the plug-in tongue 10 (stamped shape 34), and the matching counter-guide (bulge 36) of the housing 1, it is assured that the tongue 10 can only be inserted into the lock housing 1 in one, correct position, and cannot be inserted with the sides reversed. If this were possible, due to the friction of the elastically tensioned latch 25 on the smooth edge of the tongue which lies on the opposite side of the detent 14, an "apparent locking", i.e. an arresting of the tongue 10 to a certain degree, could take place, which would simulate an effective engagement, without actually obtaining the latter. As shown in FIGS. 1 and 2, the motion of the pressure organ 32 in the not-operating position is limited by the hitting of the corresponding lever element 28 at the bulge 36 of the lock-housing 1.

There is claimed:

1. Lock for a safety belt comprising a belt lock having a lock-housing with two spaced plates defining an insertion path, a plug-in tongue with a detent for insertion in the insertion path of the lock-housing, a latch mechanism having a latch of wedge-shaped cross section which can swing into the detent of the plug-in tongue when inserted in the insertion path to thereby engage said tongue, said wedge-shaped latch being swingeably supported in a corresponding wedge-shaped opening with a greater wedge angle, said latch bearing with its smaller wedge end in a curved bearing surface of said opening, said latch having at its wide end a convexly curved surface to provide a larger area for contact with said tongue to distribute a force applied to the latch over said larger area, and a pressure organ mounted on the lock-housing movable against the force of a spring to move said latch out of engagement with said tongue to permit withdrawal of the tongue from the belt lock, and wherein at both ends of said latch are fastened lever elements, which are provided with lever pins onto which said pressure organ can be pressed.

* * * * *